US005734991A

United States Patent [19]

Schmid

[11] Patent Number: 5,734,991

[45] Date of Patent: Apr. 7, 1998

[54] WEARING APPAREL WITH BACKGROUND SCENE AND DETACHABLE GAME PIECES

[76] Inventor: Marilyn Schmid, 52526 Ridgeway Ct., Shelby Township, Macomb County, Mich. 48316

[21] Appl. No.: 736,140

[22] Filed: Oct. 28, 1996

[51] Int. Cl.[6] ..... A41D 1/00

[52] U.S. Cl. ..... 2/69; 2/171; 2/1

[58] Field of Search ..... 2/171, 1, 195.1, 2/69, 244, 115, 246, 108, 102, 48, 49.1; 434/395; 237/236, 242, 263, 261, 282.1, 286, DIG. 30

[56] References Cited

U.S. PATENT DOCUMENTS

| | | | |
|---|---|---|---|
| 3,484,974 | 12/1969 | Culmone | 2/115 |
| 4,354,282 | 10/1982 | Langdon | 2/115 |
| 4,466,136 | 8/1984 | Bottom et al. | 2/115 |
| 4,611,355 | 9/1986 | Galanto et al. . | |
| 4,776,043 | 10/1988 | Coleman . | |
| 4,873,726 | 10/1989 | Tapia . | |
| 5,052,056 | 10/1991 | Braun | 2/115 |
| 5,070,545 | 12/1991 | Tapia . | |
| 5,121,505 | 6/1992 | Ludmer et al. | 2/115 |
| 5,136,726 | 8/1992 | Kellin et al. . | |
| 5,210,881 | 5/1993 | Stocker, Jr. et al. | 2/115 |
| 5,359,733 | 11/1994 | Brannon et al. . | |
| 5,359,734 | 11/1994 | Rathburn . | |
| 5,373,586 | 12/1994 | Brosnan . | |
| 5,509,144 | 4/1996 | Soergel et al. . | |

*Primary Examiner*—Gloria Hale
*Attorney, Agent, or Firm*—Harness, Dickey & Pierce, P.L.C.

[57] ABSTRACT

An article of wearing apparel capable of being worn and played with having a fabric surface including a game playing portion or background scene, and one or more removably attached articles. The game playing portion or background scene of the fabric surface having a multiplicity of loop or hook elements discretely located thereon. The removably attached articles having a multiplicity of hook or loop elements capable of engaging the loop or hook elements on the fabric surface.

20 Claims, 2 Drawing Sheets

WEARING APPAREL WITH BACKGROUND SCENE AND DETACHABLE GAME PIECES

BACKGROUND OF THE INVENTION

1. Technical Field

This invention relates generally to articles of wearing apparel having a background scene and attachable elements removably secured to the article of wearing apparel. More particularly, this invention addresses the use of an article of wearing apparel having a plurality of loop or hook elements in varied locations for removably securing various shaped articles having a plurality of hook or loop elements which engage the loop or hook elements of the article of wearing apparel.

2. Discussion

As a result of costs and competition, today's fashion industry is forced to be more creative. In an attempt to combat the continuously changing consumer desires and fashion styles, today's fashion industry must produce wearing apparel that is not only unique and personal but also adaptable to style changes and capable of serving multiple purposes.

Previously known wearing apparel having attachable decorative elements or ornaments include fabric or material wherein the elements or ornaments are directly attached to the fabric or material of the wearing apparel itself. In order to detachably secure the attachable decorative elements or ornaments to the fabric or material itself, substantively all of the exposed fabric or material surfaces of the article of apparel are made of a stretchable, flexible or elastic looped material. Using this type of special fabric or material consequently makes the manufacture of the article of apparel more difficult, time consuming and costly.

The present invention offers an article of wearing apparel having detachable decorative elements which can be easily rearranged in accordance with the wearer's various style changes and preferences. Additionally, the present invention offers an article of wearing apparel in which the detachable elements can be utilized as game pieces, for example as checkers. Thus, the present invention offers an article of wearing apparel which can be both worn and played with.

In view of the above, it is a primary object of the present invention to provide an article of wearing apparel which can be worn and played with.

It is another important object of the present invention to provide an article of wearing apparel having detachable decorative elements which can be easily rearranged and positioned at will in accordance with the wearer's various style changes and preferences.

It is another important object of the present invention to provide an article of wearing apparel having detachable decorative elements or game pieces which can be removed and rearranged with little relative effort.

SUMMARY OF THE INVENTION

The above and other objects are accomplished by a wear and play article of wearing apparel. The wear and play article of wearing apparel of the present invention generally includes an article of wearing apparel having a background scene depicted thereon. This background scene can be silk screened or painted directly onto the fabric or material of the article of wearing apparel, or applied thereto by any other suitable means. This background scene can depict any type of game board, road scene, underwater scene or virtually any other background scene. Discretely located on the article of wearing apparel and background scene are loop or hook elements capable of securing game pieces or detachable decorative elements to the article of wearing apparel. These game pieces or detachable decorative elements are appropriately shaped and two sided, the back side having hook or loop elements capable of engaging the loop or hook elements on the fabric or material of the article of wearing apparel and the front side having decorative features thereon. These game pieces or detachable decorative elements are easily removed, moved, rearranged and replaced with little effort.

In a first preferred embodiment, the background scene depicted on the article of wearing apparel is a game board and the detachable articles are game pieces. In this embodiment, it is anticipated that the article of wearing apparel could be utilized to play tic-tac-toe, checkers, chess, cribbage, backgammon or any other similar game.

In a second preferred embodiment, the article of wearing apparel provides a background scene depicting a road scene, underwater scene or virtually any other type of background scene. In the second preferred embodiment, the attachable articles are shaped as road signs, vehicles or aquatic life to name a few, or simply letters and/or numbers.

The preferred embodiments described herein form an article of wearing apparel which can be easily worn and played with, and is easily modified to satisfy the wearer's various style changes and preferences. The present invention also provides a more easily manufactured and less costly article of wearing apparel.

The above described uses are only examples, and an article of wearing apparel in accordance with the present invention may have many varied uses. These and other objects of the present invention, as well as the advantages thereof over other known wearing apparel will become apparent to those skilled in the art from the following brief description of the attached drawings, and are accomplished by means hereinafter described and claimed.

DETAILED DESCRIPTION OF THE PREFERRED EMBODIMENTS

Figure 1:
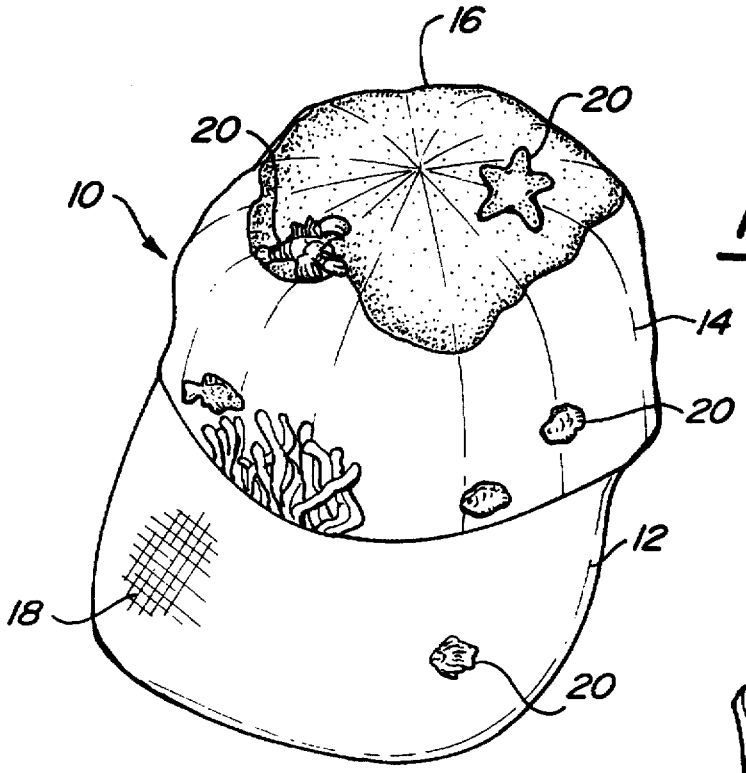
FIG. 1 illustrates an article of wearing apparel in the form of a baseball cap arranged in accordance with a preferred embodiment of the present invention.

In describing the preferred embodiments of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

Referring now to the drawings, there is depicted articles of wearing apparel embodying the concepts of the present invention. As shown in FIG. 1, the present invention is an article of wearing apparel, in this instance a baseball cap 10. Baseball cap 10 is a standard type of baseball cap having a visor or bill 12, and an outer upper surface 14. Baseball cap 10 also includes a background scene 16 depicted thereon. This background scene 16 can be painted or silk screened on the article of wearing apparel, or applied thereto by any other suitable means. In this embodiment, background scene 16 can be painted, silk screened or applied by any other suitable means on the visor or bill 12 of baseball cap 10 and the outer upper surface 14 of baseball cap 10. In this embodiment, as shown in FIG. 1, background scene 16 is an underwater or aquatic scene.

Discretely located on the article of wearing apparel are areas of looped or hooked surfaces. Shown in FIG. 1 are areas of looped surfaces 18. Areas of looped surfaces 18 may consist of general patches of looped surfaces, single strips of looped surfaces, dot shaped looped surfaces and/or square shaped looped surfaces running substantially around the entire article of wearing apparel. Areas of looped surfaces 18 are secured to the article of wearing apparel by any suitable attachment means such as adhesive or stitching. Areas of looped surfaces 18 may be the same color as the underlying article of wearing apparel but this is not required. In this embodiment, areas of looped surfaces 18 are located on visor or bill 12 of baseball cap 10 and outer upper surface 14 of baseball cap 10. Areas of looped surfaces 18 of baseball cap 10 are the same color as visor or bill 12 of baseball cap 10 and outer upper surface 14 of baseball cap 10. Removably attached articles 20 may be detachably coupled to areas of looped surfaces 18 in a number of various areas. Removably attached articles 20, however, do not have to be detachably coupled to every area of looped surfaces 18 on the article of wearing apparel.

Figure 2:
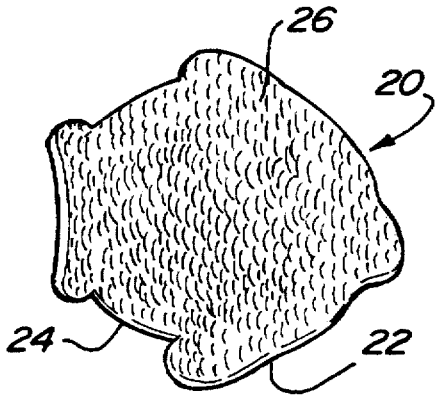
FIG. 2 is an enlarged detailed view of the attachment side of a decorative element.
Figure 4:
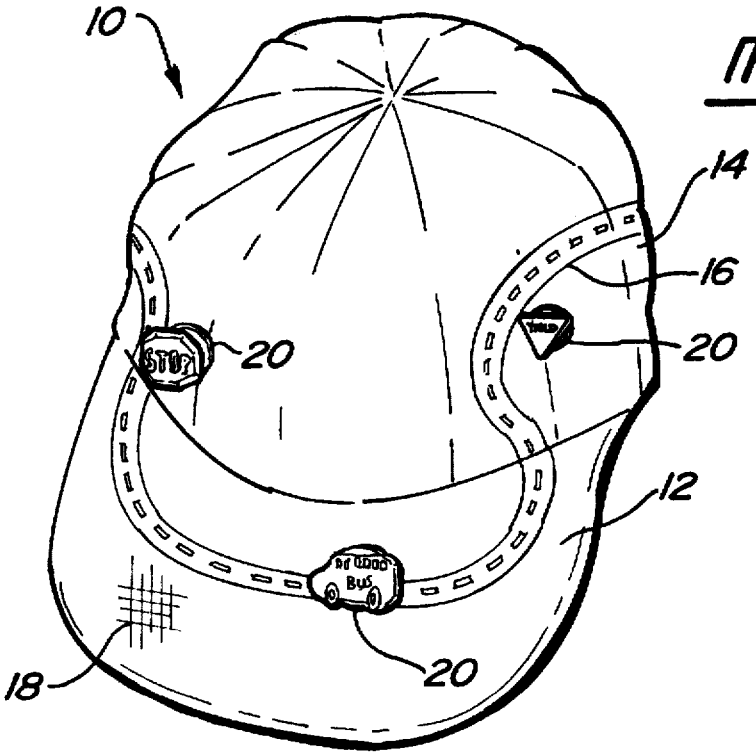
FIG. 4 illustrates an article of wearing apparel in the form of a baseball cap arranged in accordance with a third preferred embodiment of the present invention.
Figure 5:
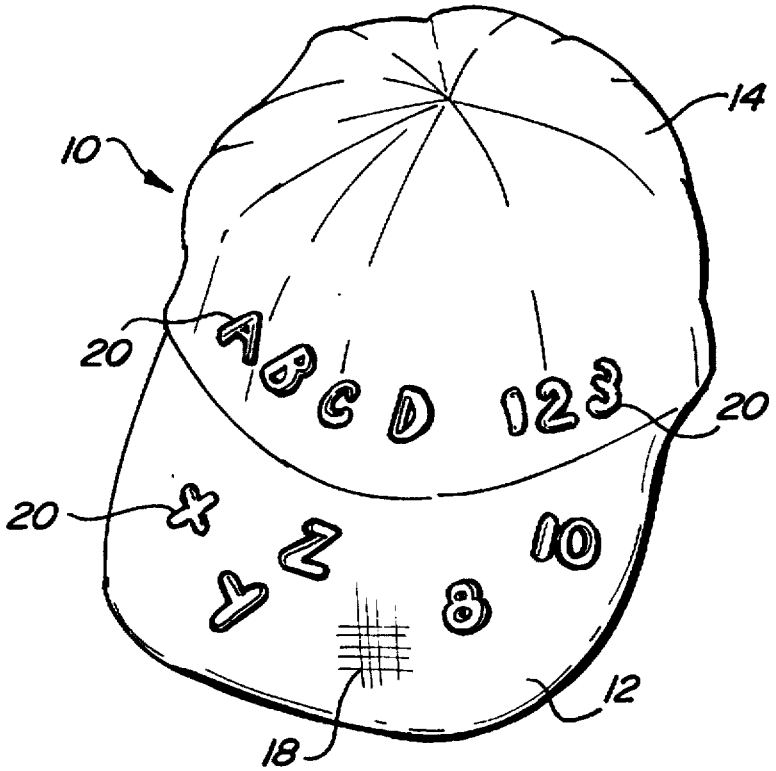
FIG. 5 illustrates an article of wearing apparel in the form of a baseball cap arranged in accordance with another preferred embodiment of the present invention.

The removably attached articles 20 can consist of a wide variety of shaped detachable decorative elements, as well as having a diverse potential for arrangement. Removably attached articles 20 can be shaped as underwater scene-related articles such as aquatic life, as shown in FIG. 1 and FIG. 2, road scene-related articles such as road signs or vehicles, as shown in FIG. 4, letters and/or numbers as shown in FIG. 5, or dinosaurs, flowers, machines, smiley faces, peace signs, cartoon characters, or virtually any other article. The removably attached articles 20 can be rather detailed, any color and made of any suitable material. As presently preferred the removably attached articles 20 are brightly colored and made of plastic.

As further shown in FIG. 2, removably attached articles 20 have a decorative, front exposed surface 22, a back base surface 24 and a multiplicity of hook elements 26. Removably attached articles 20 may also have a multiplicity of loop elements (not shown) in place of hook elements 26. Hook elements 26 are integrally attached to back base surface 24 by any suitable attachment means and are designed to hook on and attach to areas of looped surfaces 18. As described above, areas of looped surfaces 18 include a multiplicity of loop elements designed so as to catch the hook elements 26 integrally attached to back base surface 24 of removably attached articles 20. Alternatively, areas of hooked surfaces include a multiplicity of hook elements designed so as to catch the loop elements integrally attached to back base surface 24 of removably attached articles 20.

Figure 3:
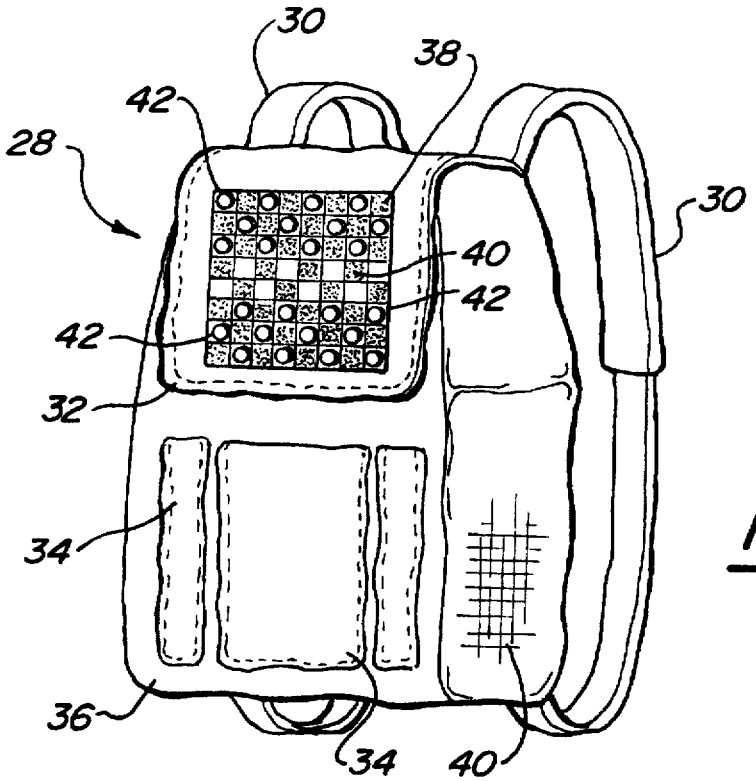
FIG. 3 illustrates an article of wearing apparel arranged in the form of a backpack in accordance with a second preferred embodiment of the present invention.

In a second preferred embodiment of the present invention, as illustrated in FIG. 3, the article of wearing apparel is a backpack 28. Backpack 28 is a standard type of backpack having shoulder straps 30, a flap portion 32, pockets 34 and an outer surface 36. Backpack 28 also includes a background scene 38 depicted thereon. Again, background scene 38 can be painted or silk screened on the article of wearing apparel, or applied thereto by any other suitable means. In this embodiment, background scene 38 can be painted, silk screened or applied by any other suitable means on the flap portion 32, pockets 34 and outer surface 36 of backpack 28. In this embodiment, as shown in FIG. 3, background scene 38 is a game board. Again, discretely located on the article of wearing apparel are areas of looped or hooked surfaces. Shown in FIG. 3 are areas of looped surfaces 40. Areas of looped surfaces 40 may consist of patches of looped surfaces, single strips of looped surfaces, dot shaped looped surfaces and/or square shaped looped surfaces. Areas of looped surfaces 40 are secured to the article of wearing apparel by any suitable attachment means such as adhesive or stitching. Areas of looped surfaces 40 may be the same color as the underlying article of wearing apparel or the corresponding game board (e.g., red and black for a checker or chess board). In this embodiment, areas of looped surfaces 40 are located on the game board and elsewhere on the backpack 28. Removably attached articles 42 may be detachably coupled to areas of looped surfaces 40 in a number of various areas. As noted above, removably attached articles 42 do not have to be detachably coupled to every area of looped surfaces 40 on the article of wearing apparel.

In this embodiment, removably attached articles 42 are game pieces. Removably attached articles 42 can be shaped as checkers, as shown in FIG. 3, chess pieces, dice, backgammon pieces, cribbage pieces, Xs and Os, or virtually any other game piece. The removably attached articles 42 can be rather detailed, any color and made from any suitable material. As presently preferred the game pieces are made of brightly colored plastic.

As described above, removably attached articles 42 also have a decorative, front exposed surface 22, a back base surface 24 and a multiplicity of hook elements 26, or loop elements (not shown) in place of hook elements 26. The hook elements 26 are again integrally attached to back base surface 24 by any suitable attachment means and designed to hook on and attach to areas of looped surfaces 40. As described above, areas of looped surfaces 40 include a multiplicity of loop elements designed so as to catch the hook elements 26 integrally attached to back base surface 24 of removably attached articles 42. Alternatively, areas of hooked surfaces include a multiplicity of hook elements designed so as to catch the loop elements integrally attached to back base surface 24 of removably attached articles 42. In this embodiment, removably attached articles 42 may be removably attached to looped surfaces 40 located elsewhere on the article of wearing apparel when not in use so as not to be lost. Background scene 38 and removably attached articles 42 may be capable of depicting a wide spectrum of games, game boards and game pieces including checkers, as shown in FIG. 3, chess, tic-tac-toe, cribbage and backgammon to name a few.

A wide spectrum of background scenes and removably attached articles are available for use with a wide variety of articles of wearing apparel. FIG. 1, FIG. 3, FIG. 4 and FIG. 5 display examples of both the variety of background scenes and removably attached articles available as well as the diverse arrangement potential of such articles. Additionally, although the article of wearing apparel illustrated in FIG. 1, FIG. 4 and FIG. 5 is a baseball cap and FIG. 3 is a backpack, the present invention is not limited to those particular articles of wearing apparel but can be adapted for a wide spectrum of articles of wearing apparel interchangeable with a wide spectrum of background scenes and a wide spectrum of removably attached articles.

Although certain preferred embodiments of the invention have been herein described in order to afford an enlightened understanding of the invention, and to describe its principles, it should be understood that the present invention is susceptible to modification, variation, innovation and alteration without departing or deviating from the scope, fair meaning and basic principles of the subjoined claims.

What is claimed is:

1. An article of wearing apparel comprising:

a fabric surface having a background scene depicted thereon including an attaching portion and a non-attaching portion, said attaching portion being at least partially located outside said background scene;

at least one removably attached article; and means for removably attaching said at least one removably attached article to said attaching portion of said fabric surface.

2. An article of wearing apparel as set forth in claim 1 wherein said article is a cap.

3. An article of wearing apparel as set forth in claim 1 wherein said article is a backpack.

4. An article of wearing apparel as set forth in claim 2 wherein said background scene is silk screened onto said fabric surface.

5. An article of wearing apparel as set forth in claim 2 wherein said background scene is painted on said fabric surface.

6. An article of wearing apparel as set forth in claim 1 wherein said background scene comprises a game board and said at least one removably attached article comprises a plurality of game pieces.

7. An article of wearing apparel as set forth in claim 1 wherein said background scene comprises a road scene and said at least one removably attached article comprises a plurality of road scene-related articles.

8. An article of wearing apparel as set forth in claim 1 wherein said background scene comprises an underwater scene and said at least one removably attached article comprises a plurality of underwater scene-related articles.

9. An article of wearing apparel comprising:

a fabric surface having a game playing portion and a non-game playing portion located thereon;

a plurality of loop elements selectively located on said game playing portion and said non-game playing portion of said fabric surface; and a plurality of removably secured articles having hook elements wherein said hook elements engage said loop elements on said game playing portion and said non-game playing portion of said fabric surface.

10. An article of wearing apparel as set forth in claim 9 wherein said game playing portion is silk screened onto said fabric surface.

11. An article of wearing apparel as set forth in claim 9 wherein said game playing portion is painted on said fabric surface.

12. An article of wearing apparel as set forth in claim 9 wherein said game playing portion comprises a game board and said plurality of removably secured articles comprise game pieces.

13. An article of wearing apparel as set forth in claim 9 wherein said game playing portion comprises a road scene and said plurality of removably secured articles comprise road scene-related articles.

14. An article of wearing apparel as set forth in claim 9 wherein said game playing portion comprises an underwater scene and said plurality of removably secured articles comprise underwater scene-related articles.

15. An article of wearing apparel as set forth in claim 9 wherein said article of wearing apparel is a cap.

16. An article of wearing apparel as set forth in claim 9 wherein said article of wearing apparel is a backpack.

17. An article of wearing apparel as set forth in claim 9 wherein said plurality of removably secured articles comprise letters and numbers.

18. An article of wearing apparel comprising:

a fabric surface having a game playing portion and a non-game playing portion located thereon;

a plurality of hook elements selectively located on said game playing portion and said non-game playing portion of said fabric surface; and a plurality of removably secured articles having loop elements wherein said loop elements engage said hook elements on said game playing portion and said non-game playing portion of said fabric surface.

19. An article of wearing apparel as set forth in claim 18 wherein said game playing portion of said fabric surface comprises a game board and said plurality of removably secured articles comprise game pieces.

20. An article of wearing apparel as set forth in claim 18 wherein said game playing portion of said fabric surface comprises an underwater scene and said plurality of removably secured articles comprise underwater scene-related articles.

* * * * *